US010896641B2

(12) United States Patent
Kim et al.

(10) Patent No.: US 10,896,641 B2
(45) Date of Patent: Jan. 19, 2021

(54) ELECTRONIC DEVICE AND METHOD FOR COMPENSATING IMAGE QUALITY OF DISPLAY BASED ON FIRST INFORMATION AND SECOND INFORMATION

(71) Applicant: Samsung Electronics Co., Ltd., Gyeonggi-do (KR)

(72) Inventors: Suyeon Kim, Gyeonggi-do (KR); Youngman Lee, Gyeonggi-do (KR); Seungjae Lee, Gyeonggi-do (KR); Namhyeon Jeon, Gyeonggi-do (KR); Kwangtai Kim, Gyeonggi-do (KR); Hyungsup Byeon, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 33 days.

(21) Appl. No.: 16/205,969

(22) Filed: Nov. 30, 2018

(65) Prior Publication Data

US 2019/0244566 A1 Aug. 8, 2019

(30) Foreign Application Priority Data

Feb. 7, 2018 (KR) ..... 10-2018-0015311

(51) Int. Cl.

*G09G 3/3233* (2016.01)
*G09G 5/02* (2006.01)
*G09G 3/3225* (2016.01)

(52) U.S. Cl.

CPC ..... *G09G 3/3233* (2013.01); *G09G 3/3225* (2013.01); *G09G 5/02* (2013.01); *G09G 2320/0285* (2013.01); *G09G 2320/0666* (2013.01)

(58) Field of Classification Search

CPC ..... G09G 3/3233; G09G 3/3225; G09G 5/02; G09G 2320/0285; G09G 2320/0666

See application file for complete search history.

(56) References Cited

U.S. PATENT DOCUMENTS

| | | | | |
|---|---|---|---|---|
| 6,601,060 | B1 * | 7/2003 | Tomaru | G06F 16/29 707/621 |
| 8,085,230 | B2 * | 12/2011 | Kim | G09G 3/3648 345/690 |
| 9,704,571 | B2 * | 7/2017 | Kim | G11C 11/4096 |
| 9,715,716 | B2 * | 7/2017 | Song | G06T 1/20 |
| 9,818,707 | B2 * | 11/2017 | Oh | H01L 45/04 |
| 2006/0238472 | A1 * | 10/2006 | Lee | G09G 3/3688 345/89 |
| 2006/0256381 | A1 * | 11/2006 | Watanabe | G06F 3/121 358/1.16 |
| 2008/0084432 | A1 * | 4/2008 | Jeon | G09G 3/3611 345/690 |
| 2015/0348476 | A1 * | 12/2015 | Yeo | G09G 3/006 345/690 |
| 2017/0169758 | A1 | 6/2017 | Park | |
| 2019/0043430 | A1 * | 2/2019 | Jung | H01L 27/3262 |

* cited by examiner

*Primary Examiner* — Ricardo Osorio
(74) *Attorney, Agent, or Firm* — Cha & Reiter, LLC.

(57) ABSTRACT

In one embodiment, there is a method for compensating for distortion on a display of an electronic device. The method comprises reading from a first memory first information for performing first compensation of pixel data, acquiring second information for performing second compensation of the pixel data, providing the second information to the display, and generating third information based on the first information and the second information.

8 Claims, 15 Drawing Sheets

| | 0 | 1 | 2 | 3 |
|---|---|---|---|---|
| R | 0 | -3 | -6 | -9 |
| G | 0 | 0 | 0 | 0 |
| B | 0 | -3 | -6 | -9 |

ELECTRONIC DEVICE AND METHOD FOR COMPENSATING IMAGE QUALITY OF DISPLAY BASED ON FIRST INFORMATION AND SECOND INFORMATION

CROSS-REFERENCE TO RELATED APPLICATION(S)

This application is based on and claims priority under 35 U.S.C. § 119 to Korean Patent Application No. 10-2018-0015311, filed on Feb. 7, 2018, in the Korean Intellectual Property Office, the disclosure of which is incorporated by reference herein in its entirety.

BACKGROUND

Field

The present disclosure relates to an electronic device and a method for compensating an image quality of a display.

Description of the Related Art

Portable electronic device use displays to convey large amount of output data and images. However, various conditions can result in distortion of the images displayed, thereby detracting from the quality of the user experience. Accordingly, it is important to prevent image distortion in displays on electronic devices.

SUMMARY

A display displaying various kinds of information is important in the age of information and communication. An organic light-emitting diode (OLED) display is be a flat display device with substantially lower weight and volume compared to a cathode ray tube (CRT). The OLED display has a plurality of pixels arranged in the form of a matrix to display an image. Each of the respective pixels may include a light-emitting element, at least one thin film transistor (hereinafter, TFT) independently driving the light-emitting element, and a storage capacitor.

The TFTs can generate different luminance levels based on received voltage. Generally, the TFT compares the received voltage to different quantization levels, and outputs a respective luminance level. However, the quantization levels can deviate among the different TFTs associated with the pixels of the display. The deviation can occur as a result of deterioration of the TFT, among other reasons. Therefore, even if the same data voltage is supplied to the respective pixels, luminance deviation (different luminance levels), may occur, causing image quality distortion, such as a face or defect.

Display manufacturers use image quality compensation algorithms to compensate for the image quality distortion before delivering the displays to the client companies that install the displays in end products, such as smartphones, and smartwatches, to name a few. However, in spite of the image quality compensation algorithm, the image quality distortion may occur during deployment with the user. Thus, there is a need for schemes capable of post-correcting the image quality distortion of the display, after leaving the manufacturer.

Aspects of the present disclosure can provide a method for compensating an image quality of a display.

In accordance with an aspect of the present disclosure, an electronic device comprises a display including a plurality of pixels, the plurality of pixels associated with corresponding pixel data, wherein the corresponding pixel data causes the plurality of pixels generate colors based on the pixel data, a first memory configured to store first information for performing first compensation of the pixel data; at least one processor, wherein the at least one processor is configured to read the first information from the first memory, acquire second information for performing second compensation of the pixel data, and provide the second information to the display so as to generate third information based on the first information and the second information.

In accordance with another aspect of the present disclosure, an electronic device comprises an input device; a display including a plurality of pixels, the plurality of pixel associated with corresponding pixel data, wherein the plurality of pixels generate colors based on the pixel data; a first memory configured to store first information for compensating the pixel data; a second memory configured to store second information for compensating the pixel data; and at least one processor, wherein the at least one processor is configured to generate third information for compensating the data information based on the first information and the second information and store the third information in the first memory.

In accordance with still another aspect of the present disclosure, a method for compensating for distortion on a display of an electronic device, the method comprising reading from a first memory first information for performing first compensation of pixel data; acquiring second information for performing second compensation of the pixel data; providing the second information to the display; and generating third information based on the first information and the second information.

In accordance with yet still another aspect of the present disclosure, a method for compensating distortion with a display in an electronic device, the method comprising reading from a first memory first information for compensating pixel data; acquiring second information for compensating the pixel data; and generating third information for compensating the pixel data based on the first information and the second information and storing the third information in the first memory.

According to the aspects of the present disclosure, it is possible to compensate for the image quality distortion phenomenon, and thus the user can be provided with a high-quality image.

DETAILED DESCRIPTION

Figure 1:
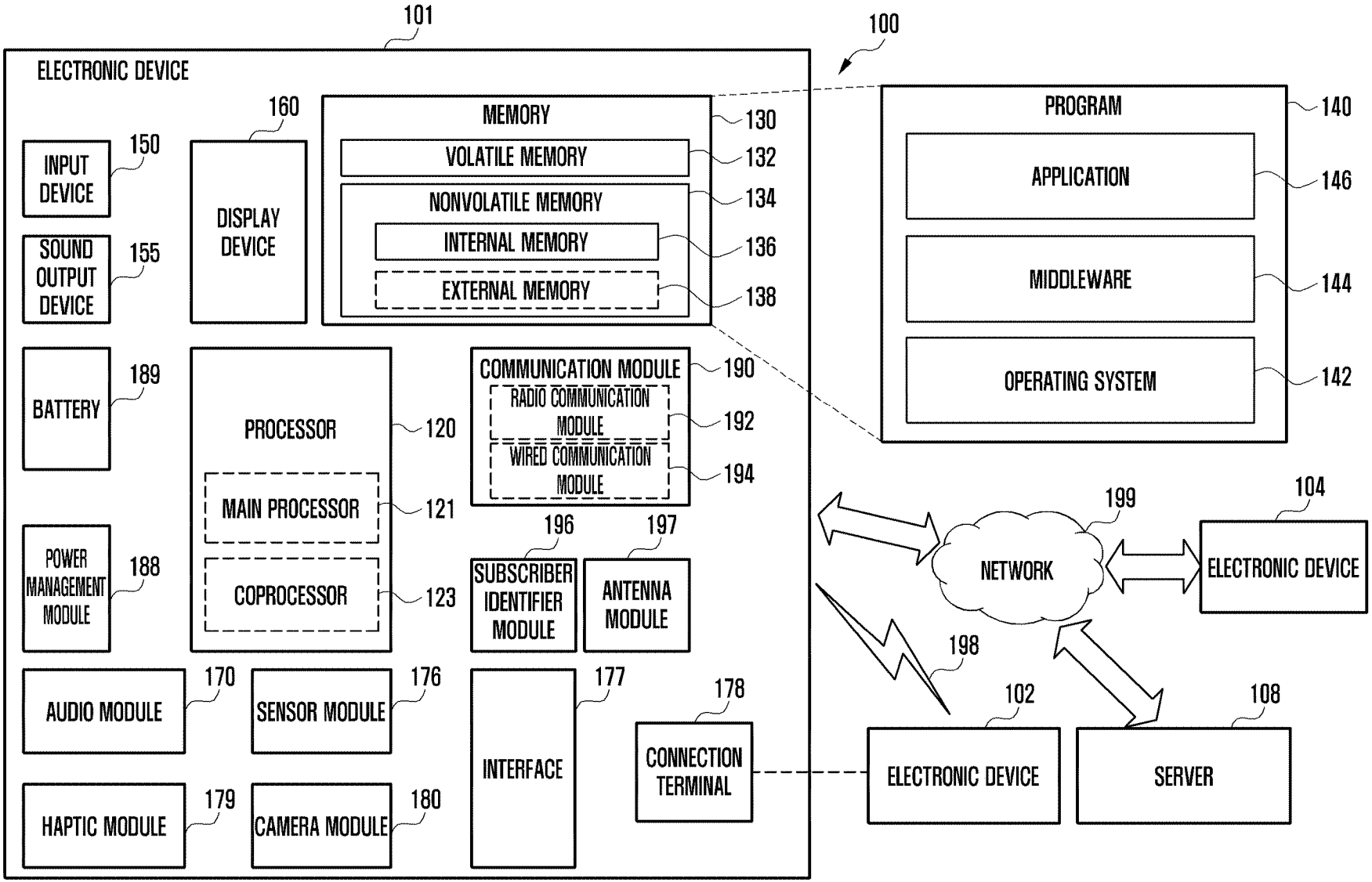
FIG. 1 is a block diagram of an electronic device in a network environment to compensate an image quality of a display based on first information and second information according to certain embodiments of the present disclosure.

FIG. 1 is a block diagram illustrating an electronic device 101 in a network environment 100 according to certain embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Display device 160 can include an OLED display. The OLED display can have a plurality of pixels arranged in the form of a matrix to display an image. Each of the respective pixels may include a light-emitting element, at least one thin film transistor (hereinafter, TFT) independently driving the light-emitting element, and a storage capacitor.

The TFTs can generate different luminance levels based on received voltage. Generally, the TFT compares the received voltage to different quantization levels, and outputs a respective luminance level. However, the quantization levels can deviate among the different TFTs associated with the pixels of the display. The deviation can occur as a result of deterioration of the TFT, among other reasons. Therefore, even if the same data voltage is supplied to the respective pixels, luminance deviation (different luminance levels), may occur, causing image quality distortion, such as a face or defect.

Certain embodiment can allow for post-correcting image distortion by the display 160, after during user deployment.

Figure 2:
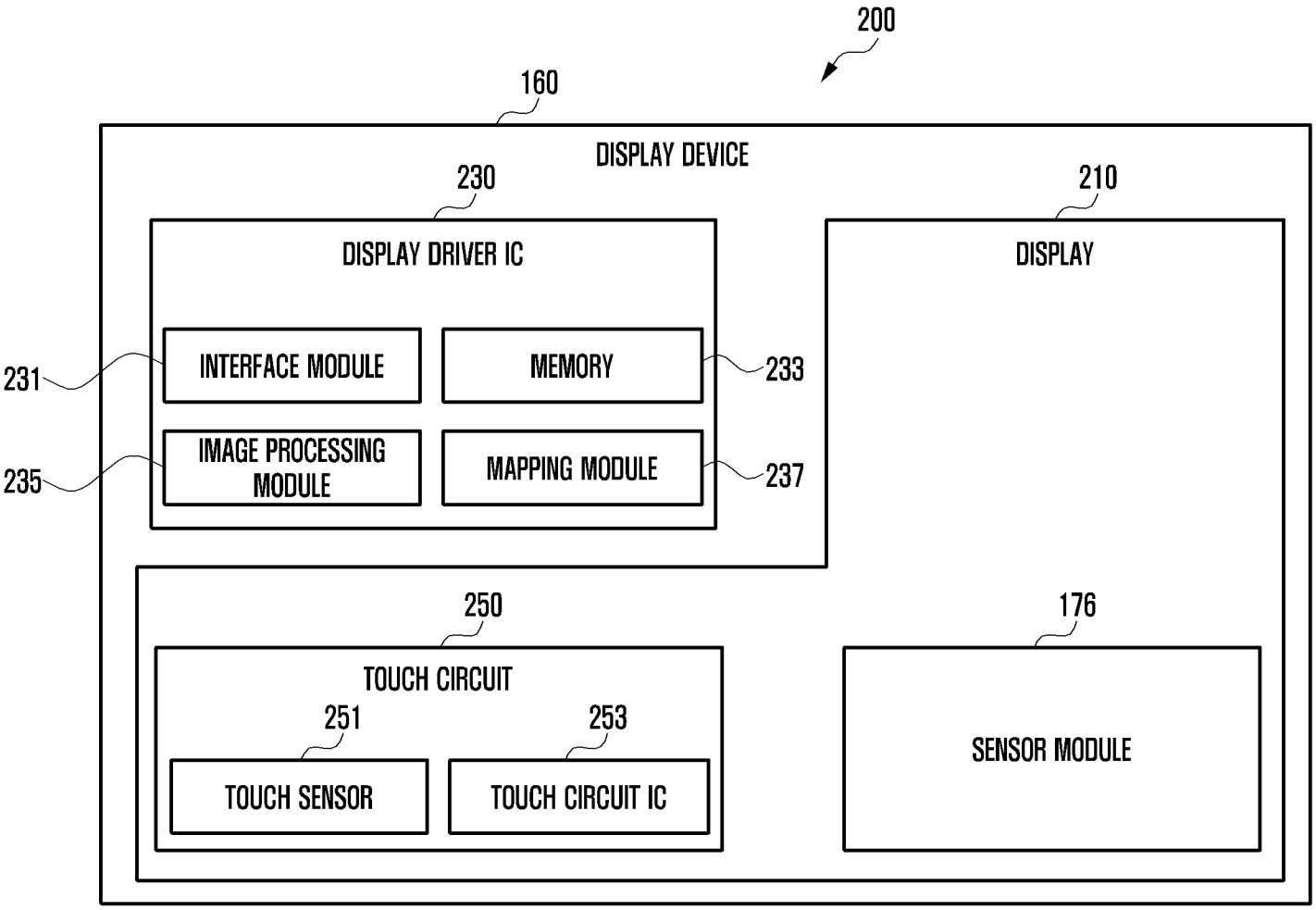
FIG. 2 is a block diagram of a display device for compensating an image quality of a display based on first information and second information according to certain embodiments of the present disclosure.

FIG. 2 is a block diagram 200 illustrating the display device 160 according to certain embodiments. Referring to FIG. 2, the display device 160 may include a display 210 and a display driver integrated circuit (DDI) 230 to control the display 210.

Display Driver Integrated Circuit

The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 150 or the sensor module 176 via the interface module 231. The DDI 230 may also store at least part of the received image information in the memory 233, for example, on a frame by frame basis.

The memory 233 can comprise a plurality of image buffers. The image buffers can have a one-to-one relationship of the pixels of the display 210, wherein units of memory (such as bytes or words) are mapped to specific pixels. The units of the memory store pixel data. Pixel data includes data structures that fully describes colors or grayscales for individual pixels of the display. In certain embodiments, the memory 233 can operate in a ping-pong scheme, wherein the pixel data for one image in one image buffer is read by the display 210, while a subsequent image is written to another image buffer. After the image in one buffer is displayed, the image in the another buffer is read and displayed and the next image is written in the first buffer. This is known as a ping pong scheme.

The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The image data may comprise pixel data that is mapped to the plurality of pixels of the display 210, wherein the plurality of pixels of the display 210 generate a color indicated by the pixel data.

The mapping module 237 may generate a voltage value or a current value corresponding to the image data pre-processed or post-processed by the image processing module 235. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

Display 210

According to an embodiment, the display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, for example, the touch sensor 251 may detect (e.g., measure) a change in a signal (e.g., a voltage, a quantity of light, a resistance, impedance, capacitance, heat, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 150)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

An electronic device 300 (in FIG. 3) according to certain embodiments of the present disclosure may include a display 320 (in FIG. 3) including a plurality of pixels, a first memory 325 (in FIG. 3) in which first information for performing first compensation of data information applied to the plurality of pixels (the data information can include pixel data, associated with the plurality of pixels, wherein the plurality of pixels generate colors based on the pixel data) is stored, a second memory 330 (in FIG. 3), and at least one processor 310 (in FIG. 3) (for purposes of this document, it shall be understood that "a processor" includes "one or more processors"), wherein the processor 310 may be configured to read the first information from the first memory 325, acquire second information for performing second compensation of the data information applied to the plurality of pixels, and provide the second information to the display 320 so as to generate third information based on the first information and the second information. The display 320 may further include a display driving circuit 323 (in FIG. 3), and the display driving circuit 323 may be configured to generate the third information based on the first information and the second information, and store the third information in the first memory. The display driving circuit 323 may be configured to generate the third information at least based on information obtained by combining the first information and the second information with each other. The first memory 325 incorporated into the display 320 or the display driving circuit 323. The processor 310 may control the display 320 to display a frame image at least based on the third information. The processor 310 may control the display 320 to display the frame image through conversion of at least one of grayscale pixel data or color pixel data corresponding to the plurality of pixels based on the third information. The processor 310 may be configured to acquire the second information from an external device.

An electronic device 300 (in FIG. 3) according to certain embodiments of the present disclosure may include an input device, a display 320 (in FIG. 3) including a plurality of pixels, a first memory 325 (in FIG. 3) configured to store first information for compensating data information applied to the plurality of pixels, a second memory 330 (in FIG. 3) configured to store second information for compensating the data information, and a processor 310 (in FIG. 3), wherein the processor 310 may be configured to generate third information for compensating the data information based on the first information and the second information and store the third information in the first memory 325. The display 320 may further include a display driving circuit 323 (in FIG. 3), and the first memory 325 may be deployed on the display driving circuit 323 or the display 320. The processor 310 may include an application processor 310.

Figure 3:
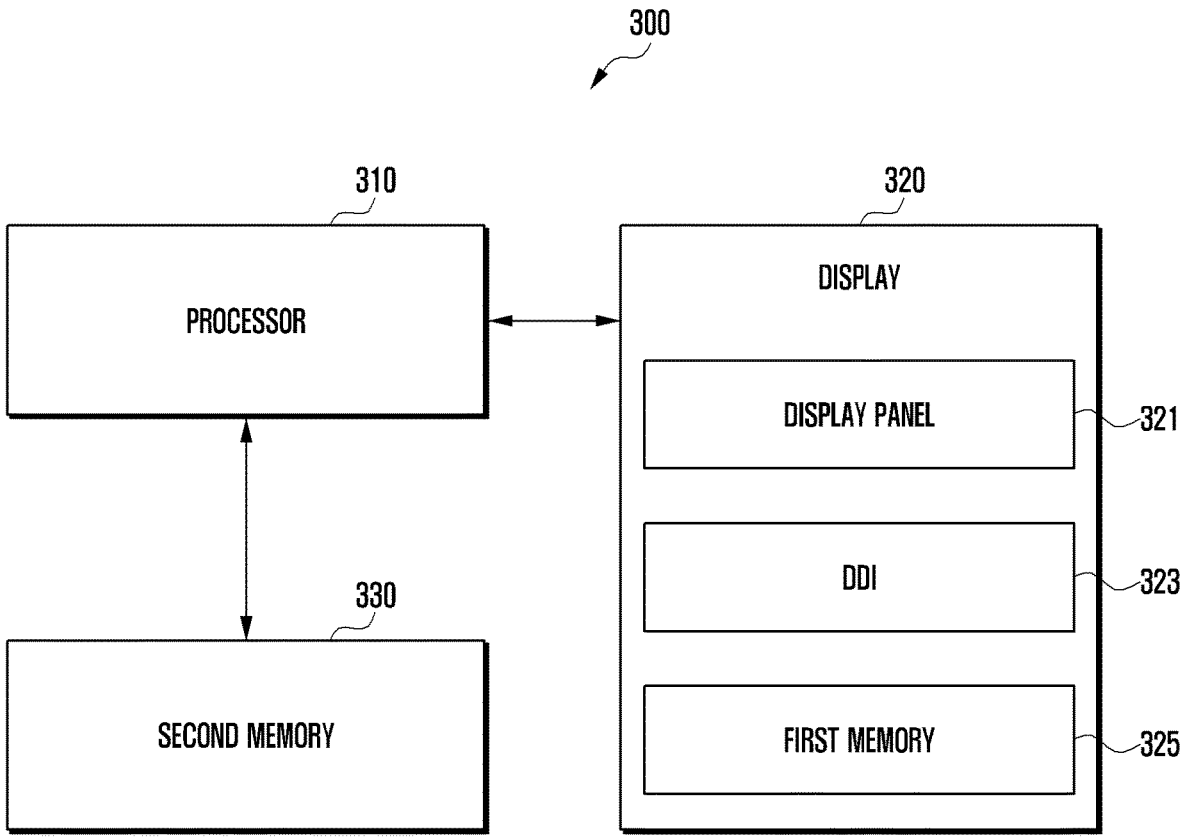
FIG. 3 is a block diagram of an electronic device according to an embodiment of the present disclosure.

FIG. 3 is a block diagram of an electronic device according to an embodiment of the present disclosure.

Referring to FIG. 3, an electronic device 300 (e.g., electronic device 101 in FIG. 1) according to an embodiment may include a processor 310 (e.g., processor 120 in FIG. 1), a display 320 (e.g., display device 160 in FIG. 1) including a first memory 325, or a second memory 330 (e.g., memory 130 in FIG. 1) outside of the display 320.

According to an embodiment, the processor 310 may be configured to update compensation data for compensating for a distortion of the display 320. For example, the processor 310 may read the compensation data stored in the first memory 325, acquire second information (such as, but not limited to, from a second memory 330, or a designated external device) for additionally compensating for the distortion of the display 320, and generate third information based on the first information and the second information. The compensation data may include data for compensating data information applied to a plurality of pixels. For example, the first information stored in the first memory 325 may include at least one value for performing first compensation of the data information, the second information acquired by the processor 310 may include at least another value for performing second compensation of the data information, and the third information generated by the processor 310 may include at least still another value obtained by combining the first information and the second information with each other.

According to one embodiment, the processor 310 may control the display 320 to generate the third information. For example, the processor 310 may acquire the second information, transmit the acquired second information to the display 320, and control the display 320 to generate the third information based on the first information and the second information stored in the first memory 325.

According to an embodiment, compensation (e.g., first compensation or second compensation) of the data information applied to the plurality of pixels by the processor 310 may be compensation (e.g., conversion) of grayscale values applied to the plurality of pixels by the processor 310. Further, the compensation (e.g., first compensation or second compensation) of the data information applied to the plurality of pixels by the processor 310 may be compensation (e.g., conversion) of color values as the data information applied to the plurality of pixels.

According to an embodiment, acquisition of the second information by the processor 310 may include acquisition of the second information based on a user input or acquisition of the second information from an external device. For example, the processor 310 may provide a user interface for compensating for the distortion of the display 320, and may acquire the second information based on the user input through the user interface. Further, the processor 310 may acquire data related to the second information from a designated external device, for example, a server.

According to a certain embodiment, acquisition of the second information from the external device by the electronic device may include the following scenarios.

Figure 5A:
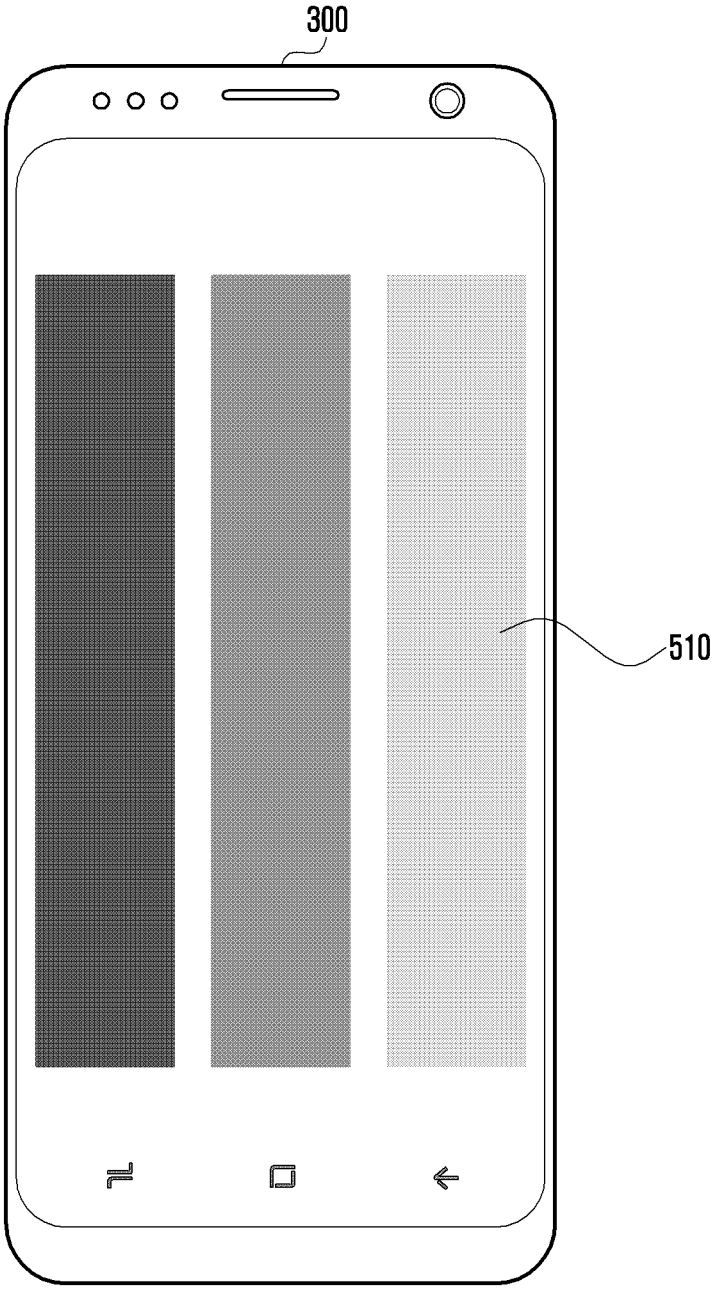
FIG. 5A, FIG. 5B and FIG. 5C are diagrams explaining a method for an electronic device to acquire second information from an external device.

(i) Under the control of the processor 310, the electronic device 300 may display a designated screen (such as a test screen, for example, the television test pattern, or the test pattern shown in FIG. 5A) for checking the distortion of the display 320.

(ii) While the electronic device 300 displays the designated screen, a first external device (e.g., electronic device of another user) may photograph (see FIG. 5B) the electronic device 300 to acquire a photographed image thereof, and may transmit the acquired photographed image to a second external device, for example, a server. In certain embodiments, the user may point the display of the electronic device towards a mirror, and the user may use the front camera (the "selfie" camera) to photograph the image in the mirror.

(iii) The second external device (e.g., server) may analyze the photographed image acquired from the first external device. The second external device, based on analysis of the photographed image, can determine the second information for compensating for the distortion of the display 320 of the electronic device 300. The server can then transmit the determined second information to the electronic device 300.

According to an embodiment, the display 320 may include a display panel 321, a DDI 323 (e.g., DDI 230 in FIG. 2), or the first memory 325. According to an embodiment, the first memory 325 may store the first information for compensating the data information applied to the plurality of pixels of the display panel 321. According to an embodiment, the DDI 323, under the control of the processor 310, may drive the display panel 321 to display a frame image based on the compensation data stored in the first memory 325. According to an embodiment, the compensation data stored in the first memory 325 may be compensation data that a manufacturer of the display panel 321 has stored by default, and may be configured to be able to be updated by the processor 310. For example, the first memory 325 may store the first information designated by the manufacturer of the display panel 321 as a default value. For example, the processor 310 may acquire the second information for compensating for the distortion of the display 320 (for example, from the server through the process described above), and generate the third information based on the acquired second information. Generating the third information from the first information and the second information may include performing a mathematical operation with the first information and the second information as the operands. In certain embodiments, the first information can be added to or subtracted from the second information. For example, the processor 310 may update the first information stored in the first memory 325 to the generated third information to be stored. According to a certain embodiment, the processor 310 may control the display 320 to generate the third information. For example, after acquiring the second information, the processor 310 may transmit the acquired second information to the display 320, and control the display 320 to generate the third information based on the second information and to store the generated third information in the first memory 325.

According to an embodiment, the second memory 330 may be configured to store the second information acquired by the processor 310 and the third information generated by the processor 310. For example, the memory storing the first information may be ROM or other memory not intended for frequent overwriting. Accordingly, the second memory can be used to store the second information and the third information based on the first information and the second information. Alternatively, in certain embodiments, the electronic device may avoid overwriting the first information. According to an embodiment, the second memory 330 may be composed of a nonvolatile memory.

A method for compensating for a distortion of a display 320 (in FIG. 3) of an electronic device 300 (in FIG. 3) according to certain embodiments of the present disclosure may include reading from a first memory 325 (in FIG. 3) first information for performing first compensation of data information applied to a plurality of pixels of a display 320, acquiring second information for performing second compensation of the data information applied to the plurality of pixels, and providing the second information to the display 320 so as to generate third information based on the first information and the second information. The display 320 may further include a display driving circuit 323 (in FIG. 3), and the method may further include controlling the display driving circuit 323 to generate the third information based on the first information and the second information, and controlling the display driving circuit 323 to store the third information in the first memory. The method may further include controlling the display driving circuit 323 to generate the third information at least based on information obtained by combining the first information and the second information with each other. The first memory 325 may be deployed on the display driving circuit 323 or the display 320. The method may further include controlling the display 320 to display a frame image at least based on the third information. Displaying the frame image may include controlling the display 320 to display the frame image through conversion of grayscale information or color information applied to the plurality of pixels based on the third information. Acquiring the second information may include acquiring the second information from an external device.

A method for compensating for a distortion of a display 320 (in FIG. 3) of an electronic device 300 (in FIG. 3) according to various embodiment of the present disclosure may include reading from a first memory 325 (in FIG. 3) first information for compensating data information applied to a plurality of pixels of a display, acquiring second information for compensating the data information, and generating third information for compensating the data information based on the first information and the second information, and storing the third information in the first memory. The method may further include controlling the display 320 to display a frame image at least based on the third information. Displaying the frame image may include controlling the display 320 to display the frame image through conversion of grayscale information or color information applied to the plurality of pixels based on the third information.

Figure 4:
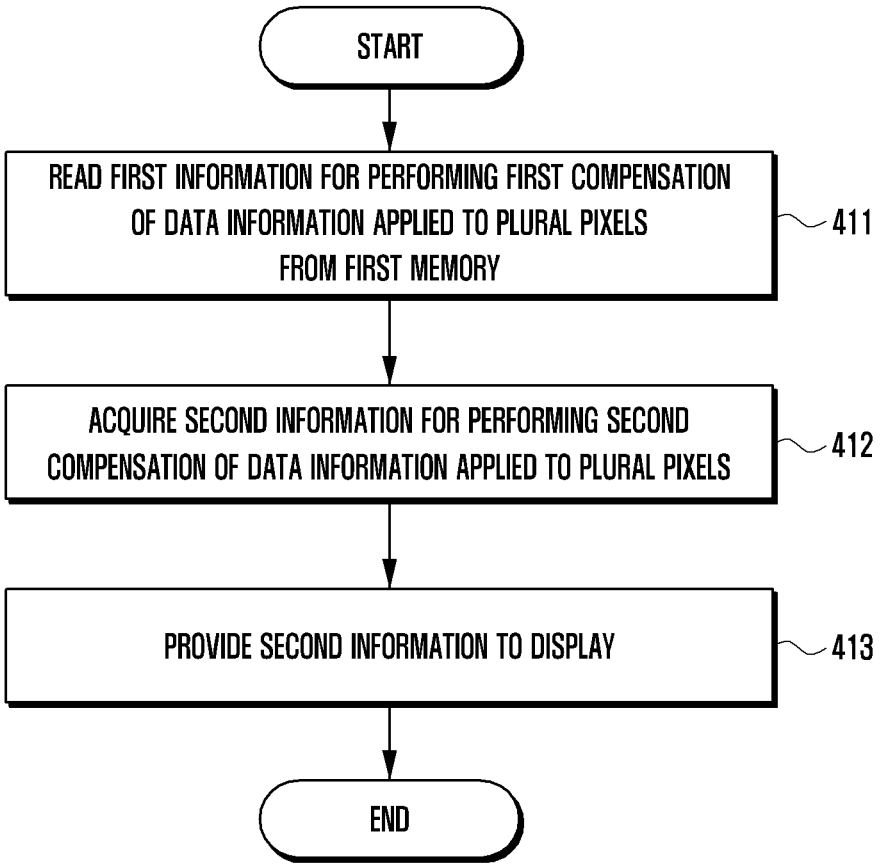
FIG. 4 is a flowchart illustrating a method for an electronic device to compensate an image quality of a display according to an embodiment of the present disclosure.

FIG. 4 is a flowchart illustrating a method for compensating the image quality of a display on an electronic device according to an embodiment of the present disclosure. The method of FIG. 4 will be described in conjunction with FIGS. 5A to 5C. For example, FIG. 4 describes a processor (e.g., processor 310 in FIG. 3) that acquires first information and second information, and generates third information based on the acquired first information and second information.

Referring to FIG. 4, at operation 411, the processor (e.g., processor 310 in FIG. 3) of the electronic device (e.g., electronic device 300 in FIG. 3) may read the first information for performing first compensation of data information applied to a plurality of pixels of a display panel (e.g., display 321 in FIG. 3) from a first memory (e.g., memory 325 in FIG. 3). For example, the first information may be compensation data pre-stored in the first memory 325 of a display (e.g., display 320 in FIG. 3) in order to compensate the data information applied to the plurality of pixels. According to an embodiment, the first memory 325 may be incorporated or integrated into the display 320. For example, the display 320 may include a display panel (e.g., display panel 321 in FIG. 3), a display driving circuit (e.g., DDI 323 in FIG. 3), 0 and a first memory 325 provided separately from the display driving circuit 323. For example, the first memory 325 may be configured to store the compensation data for compensating for a distortion of the display panel 321. According to an embodiment, the first memory 325 may be composed of a nonvolatile memory.

At operation 412, the processor 310 may acquire the second information for performing second compensation of the data information applied to the plurality of pixels.

The processor 310 may acquire the second information for performing second compensation separately from the first compensation of the data information by the first information stored in the first memory 325. The processor 310 may store the acquired second information in a second memory (e.g., second memory 330 in FIG. 3).

Acquisition of the second information by the processor 310 may include displaying a user interface for acquiring the second information by the processor 310, and acquiring the second information based on a user input through the user interface. The user interface may include a plurality of user selection menus or a plurality of icons to which the compensation information is mapped. For example, the processor 310 may display a user interface for compensating an image quality of the display 320, and may acquire the second information based on the user's icon selection (or menu selection) through the user interface. The user interface may include a plurality of icons (or menus) mapped to application of the compensation data of a color designated with respect to a designated region of the display 320. For example, the processor 310 may display as a preview image an example in which the compensation data is applied to the data information applied to the plurality of pixels in a currently displayed frame. For example, if a user selects application of a selected icon after confirming the preview image, the processor 310 may determine a compensation value for compensating the data information applied to the plurality of pixels, that is, the second information. The second information may be compensation data corresponding to the icon selected and applied by the user.

The second information may be a compensation value for applying data compensation of a grayscale or color designated with respect to the designated region of the display 320.

The designated region of the display 320 may include at least a partial region of the display 320. For example, the designated region of the display 320 may include at least a partial border region of the display 320. Further, the designated region of the display 320 may include an edge region deployed on at least one side of the display 320. The edge region of the display 320 may include at least a partial region deployed between a front surface of the display 320 and at least one side surface of the display 320. For example, the edge region of the display 320 may include a region connecting the front surface of the display 320 and at least a part of one side surface of the display 320. According to an embodiment, at least a part of the edge region may include a curved region having a curvature of a designated range. According to a certain embodiment, the designated region may include a region that the process 310 determines based on the user input.

According to an embodiment, the designated color may be red, green, or blue. As an alternative, the designated color may include a color of a combination selected among red, green, and blue.

According to an embodiment, compensation (e.g., first compensation or second compensation) of the data information applied to the plurality of pixels by the processor 310 may be compensation (conversion) of grayscale values applied to the plurality of pixels by the processor 310. Further, the compensation (e.g., first compensation or second compensation) of the data information applied to the plurality of pixels by the processor 310 may be compensation (conversion) of color values as the data information applied to the plurality of pixels. For example, the plurality of pixels may include a first sub-pixel displaying a first color (e.g., red, rgb(255, 0, 0)), a second sub-pixel displaying a second color (e.g., blue rgb(0, 0, 255)), and a third sub-pixel displaying a third color (e.g., green, rgb(0, 255, 0)), and may be composed of a plurality of unit pixels displaying a specific color as a combination of the first to third sub-pixels. According to an embodiment, the compensation (conversion) of the color value by the processor 310 may be compensation (conversion) of the color displayed by the plurality of unit pixels, and for example, it may be an operation in which the processor 310 compensates color coordinates of the color displayed by the respective unit pixels.

According to a certain embodiment, acquisition of the second information by the processor 310 may include reception of the second information from an external device by the processor 310 and storage of the received second information in the second memory 330. According to an embodiment, the external device may be a server provided by a manufacturer of the electronic device 300. For example, the processor 310 may access the server provided by the manufacturer of the electronic device 300, download update information for compensating for the distortion of the display 320 from the server as the second information, and install and store the downloaded second information in the second memory 330.

Figure 5B:
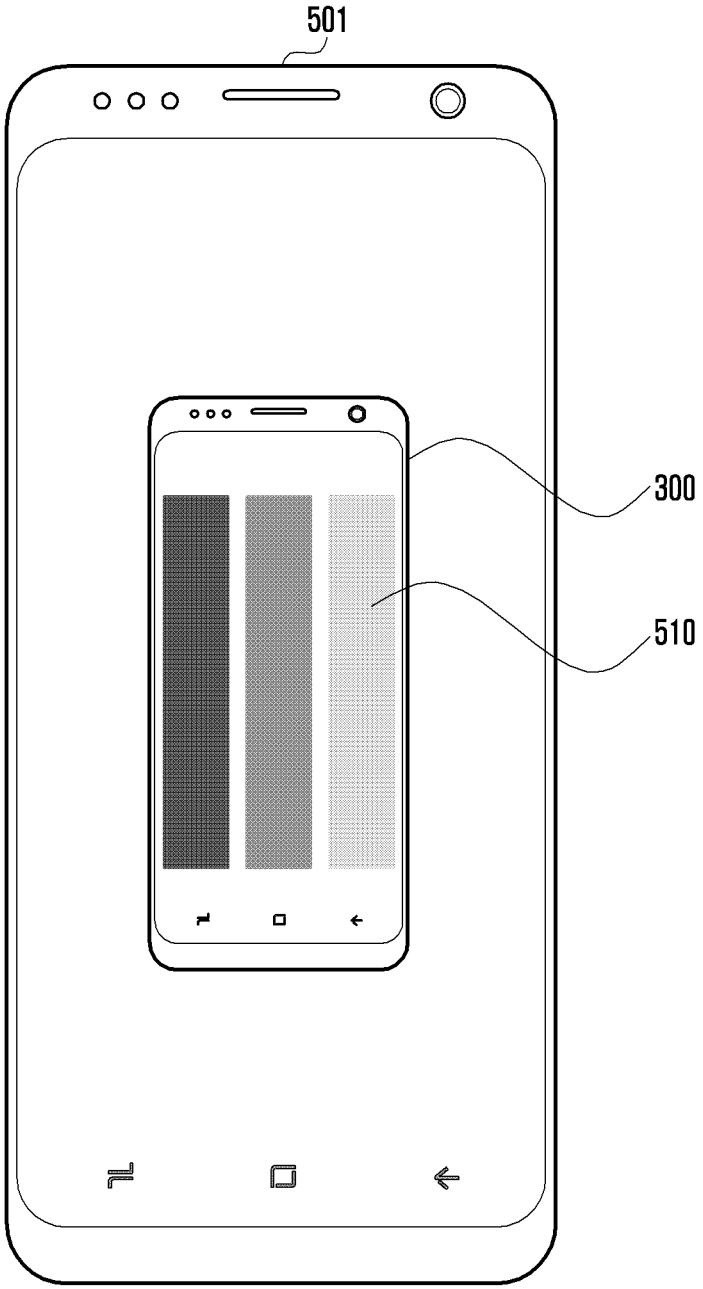
Figure 5C:
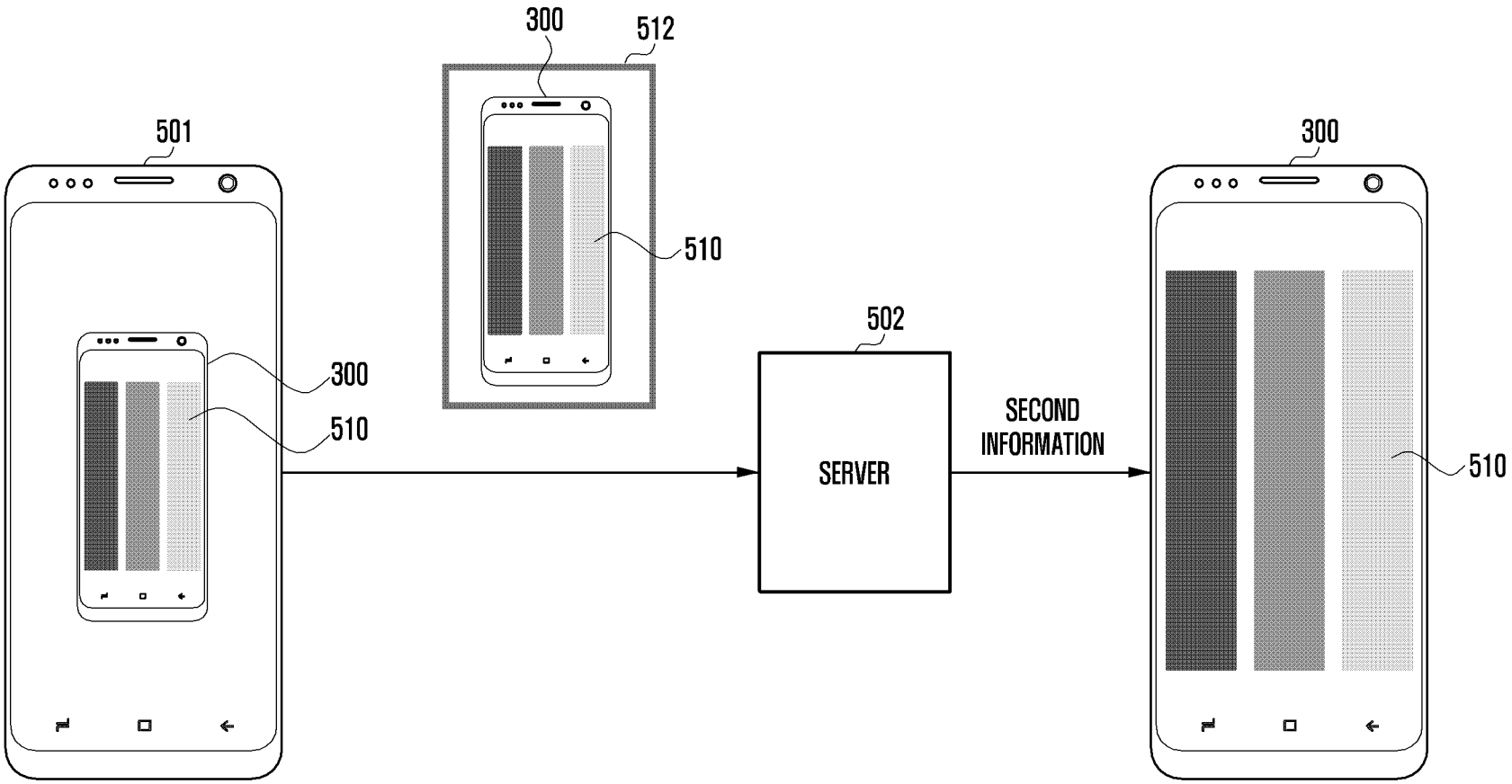

According to a certain embodiment, acquisition of the second information from the external device by the processor 310 may include the following scenarios. For example, as illustrated in FIG. 5A, the electronic device 300, under the control of the processor 310, may display a designated screen 510 for checking the distortion of the display 320. The designated screen 510 may include a region displaying at least one designated color. For example, the designated screen 510 may be composed of a region displaying only a single designated color. Further, the designated screen 510 may be composed of regions displaying at least one designated color, for example, displaying at least one color selected from white, red, green, and blue. As illustrated in FIGS. 5B and 5C, a first external device (e.g., electronic device of another user) 501 may photograph the electronic device 300 while the electronic device 300 displays the designated screen, and transmit a photographed image 512 of the electronic device 300 to a second external device, for example, a server 502. In one embodiment, the user may turn the display to face a mirror and use the front camera to photograph the image in the mirror. The server 502 may analyze the photographed image 512 acquired from the first external device 501, and determine the second information for compensating the distortion of the display 320 of the electronic device 300 based on the result of the analysis. The server 502 may determine the second information, and then transmit the determined second information to the electronic device 300. For example, the electronic device 300 may acquire the second information from the server 502 using a communication module (e.g., communication module 190 in FIG. 1), and store the acquired second information in the second memory 330.

At operation 413, the processor 310 according to an embodiment may provide the second information to the display 320. For example, the processor 310 may acquire the second information based on the user input through the user interface or the update information received from the external device, and provide the acquired second information to the display 320. According to an embodiment, providing of the second information to the display driving circuit 323 by the processor 310 may be an operation in which the processor 310 provides the second information to the display driving circuit 323, and controls the display driving circuit 323 to generate the third information based on the first information and the second information. For example, under the control of the processor 310, the display driving circuit 323 may generate the third information based on the first information and the second information, and store the generated third information in the first memory 325. According to an embodiment, the display driving circuit 323 may update the first information stored in the first memory 325 to the third information. The processor 310 may control the display 320 to compensate the data information applied to the plurality of pixels with the designated value based on the third information stored in the first memory 325 and to display the compensated frame image.

As described above, the third information may be information obtained by accumulating the second information acquired by the processor 310 on the first information pre-stored in the first memory 325. For example, under the control of the processor 310, the display driving circuit 323 may generate the third information by adding first compensation data based on the first information and second compensation data based on the second information to each other. As an alternative, the third information may not be generated by the display driving circuit 323, but may be generated by the processor 310. As described above, an example in which the processor 310 generates the third information will be described later with reference to FIG. 6.

Figure 6:
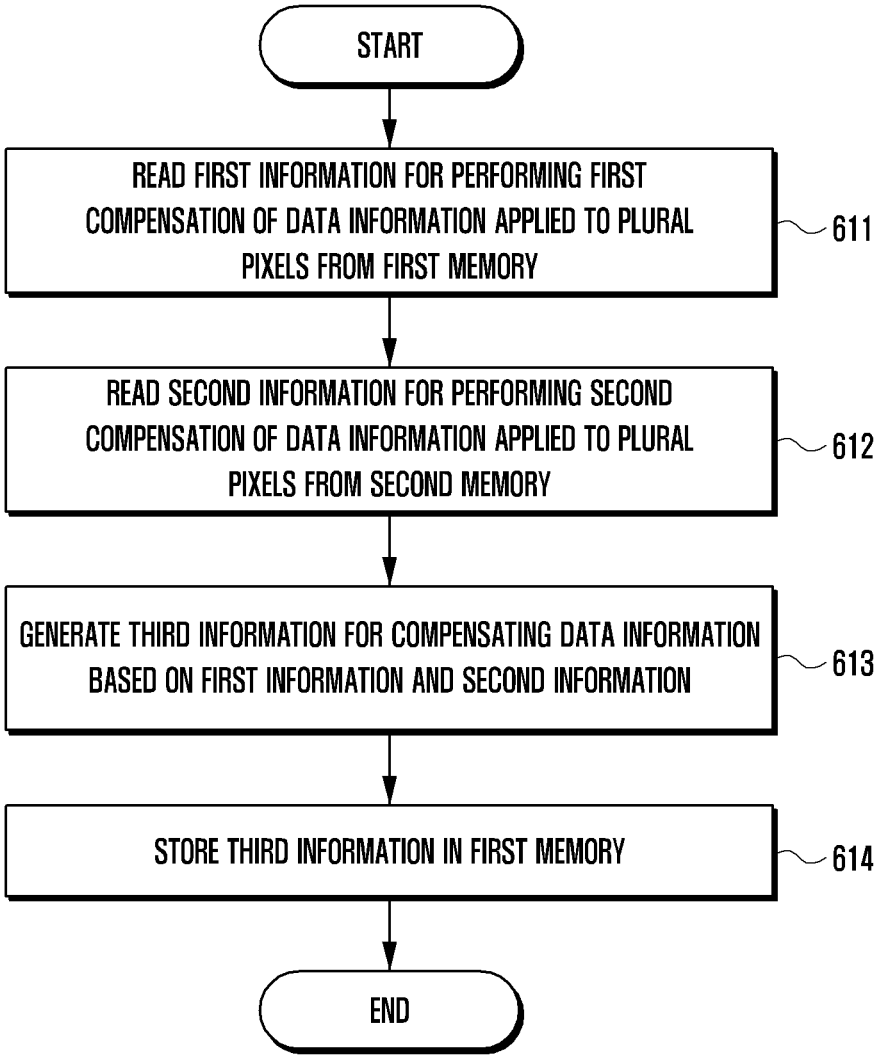
FIG. 6 is a flowchart illustrating a method for an electronic device to compensate an image quality of a display according to another embodiment of the present disclosure.

FIG. 6 is a flowchart of a method for compensating image quality of a display according to another embodiment of the present disclosure. The processor (e.g., processor 310 in FIG. 3) acquires the first information and the second information, and generates the third information based on the acquired first information and the second information.

Referring to FIG. 6, at operation 611, the processor (e.g., processor 310 in FIG. 3) of the electronic device (e.g., electronic device 300 in FIG. 3) may read the first information for performing first compensation of data information applied to a plurality of pixels from a first memory (e.g., memory 325 in FIG. 3). For example, the first information may be compensation data pre-stored in the first memory 325 in order to compensate the data information applied to the plurality of pixels. The first information may be written by the original equipment manufacturer.

At operation 612, the processor 310 according to another embodiment may read from the second memory (e.g., memory 330 in FIG. 3) the second information for performing second compensation of the data information applied to the plurality of pixels. For example, the processor 310 may acquire the second information in the same or similar method as or to that as described above at operation 412 of FIG. 4, and store the acquired second information in the second memory 330. The processor 310 may store the second information in the second memory 330, and then read the second information from the second memory 330. As an alternative, the processor 310 may directly perform an operation for generating the third information after acquiring the second information, and in this case, the processor 310 may store the second information acquired by the processor 310 in the second memory 330, and read the second information stored in the second memory in a state where at least a part of the second information may be omitted.

At operation 613, the processor 310 according to another embodiment may generate the third information for compensating the data information based on the first information and the second information. For example, unlike the example of FIG. 3, the third information may be directly generated by the processor 310.

At operation 614, the processor 310 according to another embodiment may store the generated third information in the first memory 325. For example, the processor 310 may store the third information in the first memory 325, and then control the display (e.g., display 320 of FIG. 3) to compensate the data information applied to the plurality of pixels with a designated value based on the third information stored in the first memory 325 and to display the compensated frame image.

Figure 7:
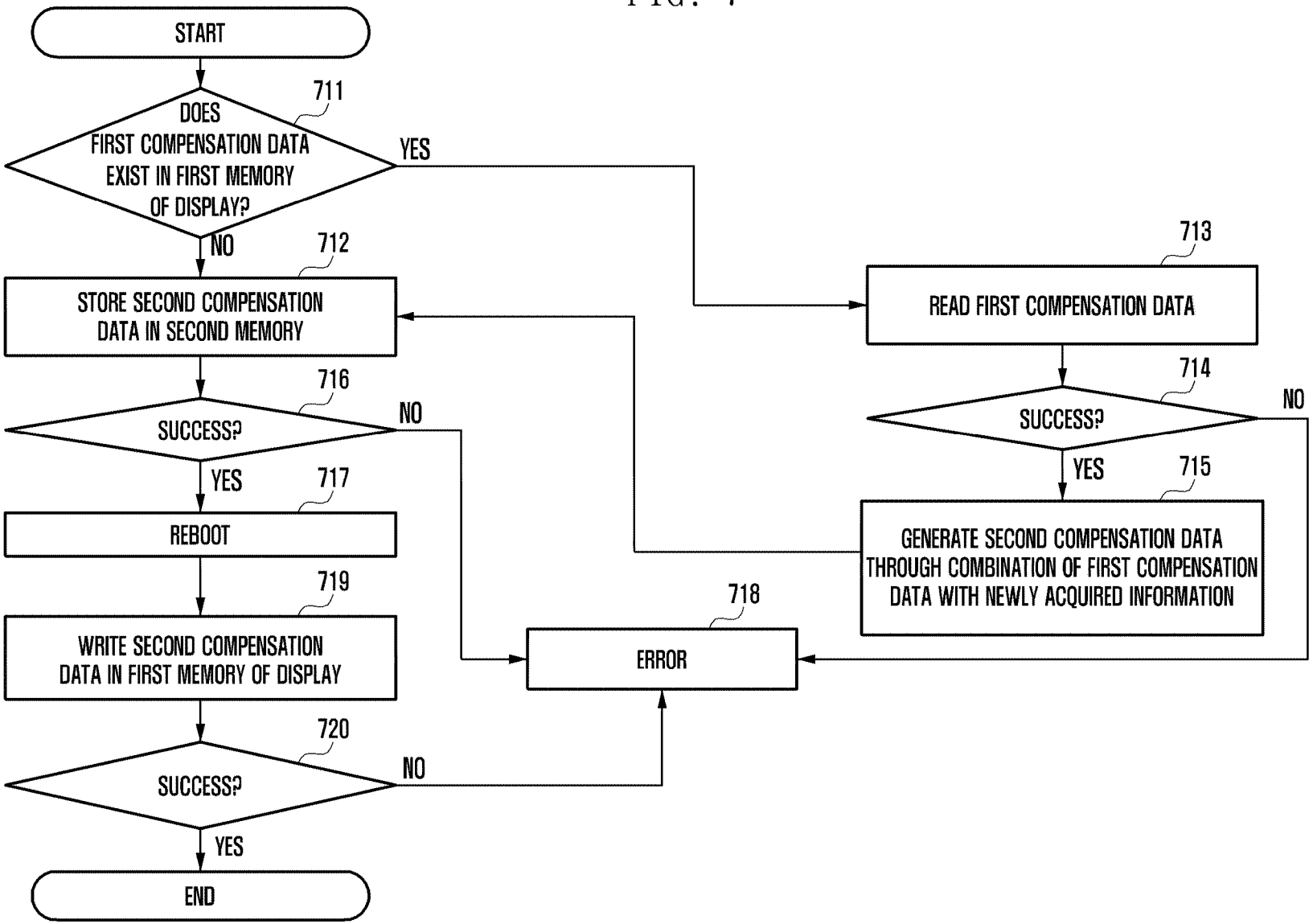
FIG. 7 is a flowchart illustrating in more detail a process in which an electronic device compensates an image quality of a display.

FIG. 7 is a flowchart illustrating in more detail a process in which an electronic device compensates an image quality of a display.

Referring to FIG. 7, at operation 711, an electronic device (e.g., electronic device 300 in FIG. 3) according to an embodiment may determine whether the first information for performing first compensation of the data information applied to the plurality of pixels, for example, first compensation data, exists in the first memory (e.g., memory 325 in FIG. 3). If the first compensation data exists, the processor 310 performs operation 713, whereas if the first compensation data does not exist, the processor 310 performs operation 712.

At operations 713 to 715, the processor 310 according to an embodiment may read the first compensation data, and generate the second compensation data through combination of the first compensation data with the second information that is newly acquired information. For example, as described above at operation 311 of FIG. 3, the processor 310 may acquire the second information, and generate the second compensation data (e.g., third information as described above with reference to FIGS. 3 and 4) through combination of the acquired second information with the first compensation data. If the first compensation data cannot be read, the processor 310 may determine indicate that there is an error during operation 718.

At operations 712 and 716, the processor according to an embodiment may store the second compensation data in the second memory (e.g., memory 330 in FIG. 1). The processor 310 may store the second compensation data in the second memory 330. The processor 310 may determine error occurrence if the second compensation data cannot be stored in the second memory 330.

At operations 717 and 719, the processor 310 according to an embodiment of the present disclosure may reboot (start again) the electronic device 300 after storing the second compensation data in the second memory 330. According to an embodiment, if the whole system of the electronic device 300 is rebooted, the processor 310 may start the system in a recovery mode. According to another embodiment, the processor 310 may omit the rebooting of the whole system of the electronic device 300 after storing the second compensation data in the second memory 330. For example, the processor 310 may execute the recovery mode in a background state after storing the second compensation data in the second memory 330.

According to an embodiment, the recovery mode may include a user interface for changing the setting related to the system of the electronic device 300 or recovering the setting of the changed system. For example, in the recovery mode, the electronic device 300 may output a user interface for updating the first compensation data stored in the first memory 325 of the display 320. If the recovery mode of the electronic device 300 is executed, the processor 310 may store the second compensation data stored in the second memory 330 in the first memory 325 of the display 320.

At operation 720, the processor 310 according to an embodiment may store the second compensation data in the first memory 325 of the display 320, reboot the whole system of the electronic device 300, and then start the system in a normal mode. If the second compensation data cannot be stored in the first memory 325 of the display 320, the processor 310 may determine an error condition.

According to an embodiment, if the error condition is determined, the processor 310 may generate a designated popup message or designated vibration, or output a designated sound. According to an embodiment, if the error occurrence is determined, the processor 310 may end an operation of compensating an image quality of the display. According to a certain embodiment, if the error occurrence is determined, the processor 310 may end the error occurrence operation, and may be configured to re-perform the operation before the error occurrence. According to a certain embodiment, if the number of the same error occurrences exceeds a predetermined number after the processor 310 re-performs the operation before the error occurrence, the processor 310 may end the operation of compensating the image quality of the display.

Figure 8:
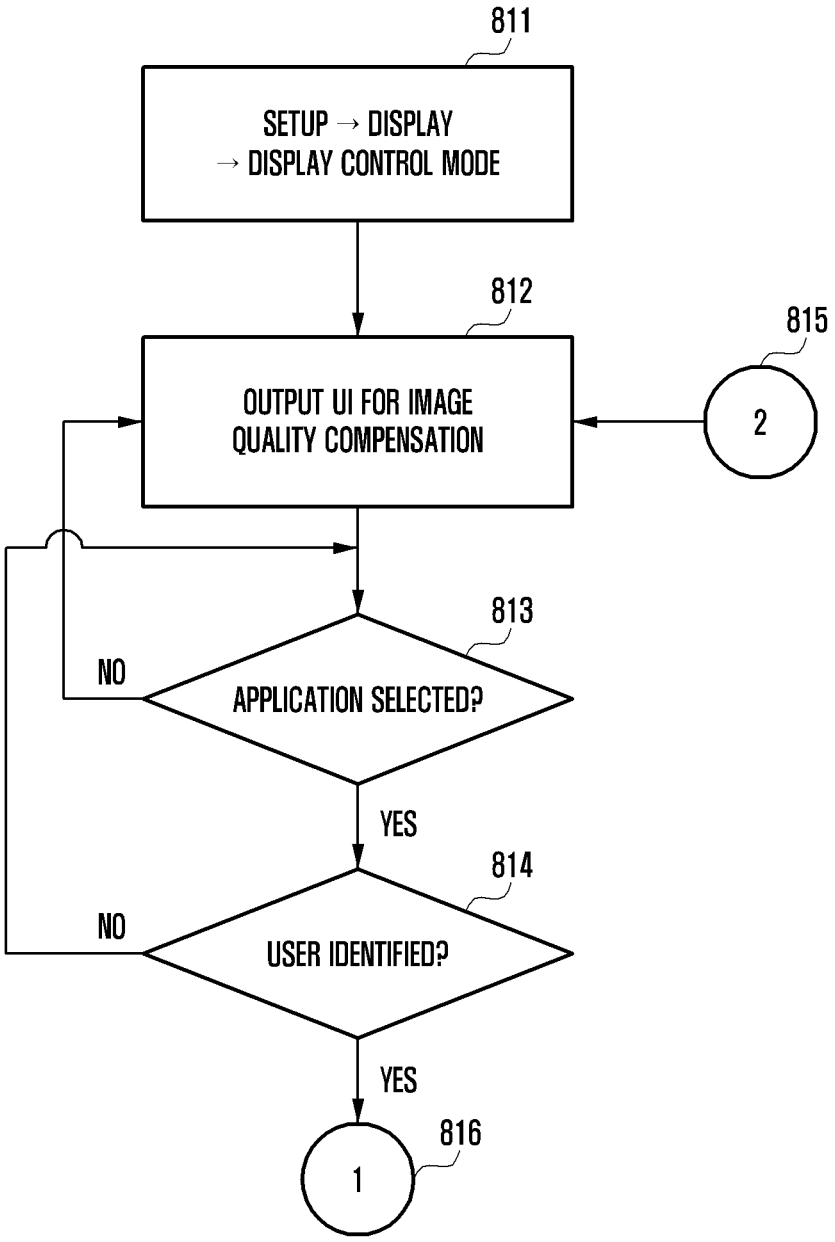
FIG. 8 is a flowchart illustrating a process in which an electronic device determines compensation data for compensating an image quality of a display.

FIG. 8 is a flowchart of a method for selecting compensation data for compensating an image quality of a display. For example, FIG. 8 may be a detailed flowchart illustrating an operation of acquiring second information at operation 412 in FIG. 4.

Referring to FIG. 8, at operation 811, the processor (processor 310 in FIG. 3) of the electronic device (e.g., electronic device 300 in FIG. 3) according to an embodiment may display a user interface for compensating an image quality of the display (e.g., display 320 in FIG. 3) in response to a user input. For example, in response to the user input for selecting the display 320 in a setup menu of the electronic device 300, the processor 310 may display a setup menu for the display 320, and display the user interface for compensating the image quality of the display 320 in response to the user input for selecting a display control mode in the setup menu of the display 320.

At operation 812, the processor 310 according to an embodiment may display the user interface for compensating the image quality with respect to a designated region. According to an embodiment, the user interface may include a plurality of icons (or menus) mapped to application of the compensation data of a color designated with respect to the designated region of the display 320. According to an embodiment, the user interface for compensating the image quality of the display 320 may include a menu for selecting the designated region. For example, the processor 310 may receive the user input for selecting the designated region through the user interface. According to an embodiment, the designated region of the display 320 may include at least a partial region of the display 320. For example, the designated region of the display 320 may include a border region of the display 320. Further, the designated region of the display 320 may include an edge region deployed on at least one side of the display 320. Further, the processor 310 may provide a selection tool for a user to directly set the designated region of the display 320. The processor 310 may determine the designated region in response to the user input using the selection tool.

According to an embodiment, in response to a case where the user selects any one of the plurality of icons, the processor 310 may display as a preview image an example in which the compensation data is applied to the data information applied to the plurality of pixels in a currently displayed frame.

At operations 813 and 814, in response to a case where the user selects the application and confirms the selection, the processor 310 according to an embodiment may determine a compensation value for compensating the data information applied to the plurality of pixels, that is, the second information. According to an embodiment, the second information may be compensation data corresponding to the icon selected and applied by the user. According to an embodiment, the second information may be a compensation value for applying data compensation of a grayscale or color designated with respect to the designated region of the display 320. According to an embodiment, the designated color may be red, green, or blue. As an alternative, the designated color may include a color of a combination selected among red, green, and blue.

According to an embodiment, if the second information is determined, the processor 310 may perform operation 816.

At operation 815, the processor 310 according to an embodiment may sense user cancellation while displaying the user interface for compensating the image quality of the display 320, and if the cancellation is sensed, the processor 310 may be configured to re-perform operation 812. Accordingly, the electronic device 300 according to the present disclosure may return to a screen for newly setting the second information any time in response to the user's cancellation selection.

According to a certain embodiment, while performing any one of the operations illustrated in FIG. 8, the processor 310 may determine whether a battery capacity is larger than a designated value. According to an embodiment, if the battery capacity is smaller than the designated value, the processor 310 may output a low-battery notification. For example, as the low-battery notification, the processor 310 may generate a designated popup message, generate designated vibration, or output designated sound. According to a certain embodiment, if the battery capacity is smaller than the designated value, the processor 310 may end the operation of compensating the image quality of the display.

Figure 9:
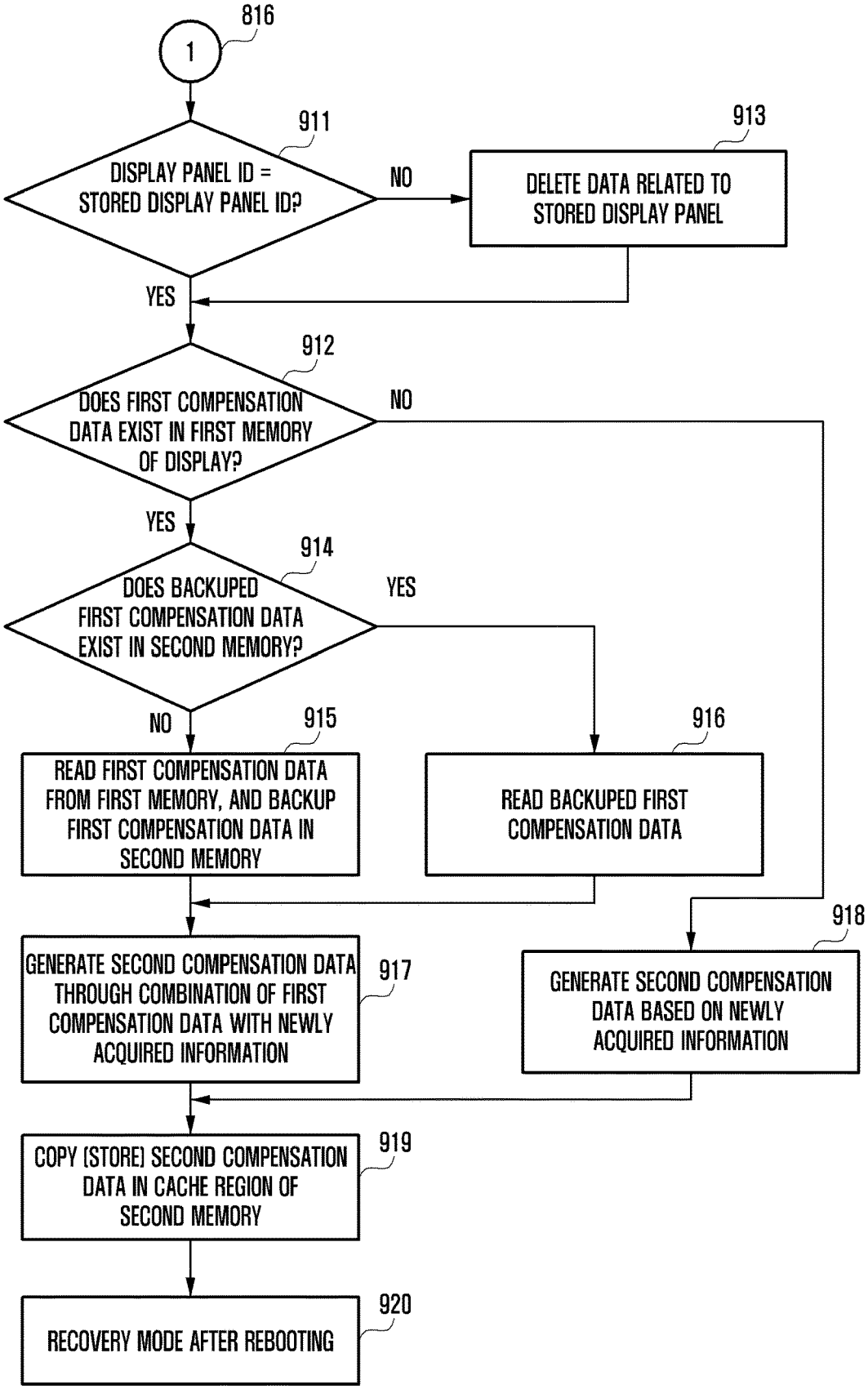
FIG. 9 is a flowchart illustrating a pre-process in which an electronic device stores compensation data in a memory of a display.

FIG. 9 is a flowchart illustrating a pre-process in which an electronic device stores compensation data in a memory of a display. For example, FIG. 9 may be a flowchart explaining in detail operations after operation 816 illustrated in FIG. 8.

Referring to FIG. 9, at operation 911, the processor (e.g., processor 310 in FIG. 3) of the electronic device (e.g., electronic device 300 in FIG. 3) may determine whether identification information of the display 320 acquired from the display (e.g., display 320 in FIG. 3) is equal to identification information of the display 320 stored in the second memory (e.g., memory 330 in FIG. 3). The identification information can include manufacturers serial number of the display 320. Since the compensation information is derived from testing of the display 320, the identification information can be used to confirm that the compensation information was derived specifically from the display 320.

If the identification information of the display 320 acquired from the display 320 is equal to the identification information of the display 320 stored in the second memory 330, the processor 310 performs operation 912, whereas if the identification information of the display 320 acquired from the display 320 is not equal to the identification information of the display 320 stored in the second memory 330, the processor 310 may delete data related to the panel of the display 320 stored in the second memory 330 (S913). The processor 310 may delete the data because it was derived from testing of another display besides display 320. For example, at operation 913, the processor 310 may delete the compensation data related to the panel of the display 320 stored in the second memory 330. At operations 912 and 914, the processor 310 according to an embodiment may confirm whether the first compensation data exists in the first memory (e.g., memory 325 in FIG. 3) of the display 320, and confirm whether the first compensation data that is backup data exists in the second memory 330.

According to an embodiment, the processor 310 may store the original first compensation data initially stored before updating the first compensation data stored in the first memory 325 in the second memory 330 as backup data (or original data). Accordingly, whenever the distortion of the display is compensated for, the electronic device 300 according to the present disclosure may set the original first compensation data as a reference, and generate the second compensation data through combination of the original first compensation data set as a reference and new information with each other. Accordingly, existence of the backup data in the second memory 330 may mean that there is a history of updates of the compensation data previously stored in the first memory 325. Further, in case of updating the compensation data initially stored in the first memory 325, the second memory 330 might not store the backup data.

According to an embodiment, the processor 310 may perform operation 918 if the compensation data stored in the first memory 325 does not exist.

According to an embodiment, if the compensation data stored in the first memory 325 exists, and the first compensation data backed up in the second memory 330 does not exist, the processor 310 may perform operation 915. According to an embodiment, if the compensation data stored in the first memory 325 exists, and the first compensation data backed up in the second memory 330 does not exist, the processor 310 may perform operation 916.

At operation 915, the processor 310 according to an embodiment may read the first compensation data from the first memory 325, and backup (store) the first compensation data in the second memory 330 as the original data. According to an embodiment, the processor 310 may store the first compensation data in the second memory initially only once.

At operation 916, the processor 310 according to an embodiment may read the backup first compensation data from the second memory 330.

At operation 917, the processor 310 according to the present disclosure may generate the second compensation data (e.g., third information as described above with reference to FIGS. 4 and 6) through combination of the first compensation data read at operation 915 or 916 and newly acquire information with each other.

At operation 918, the processor 310 according to an embodiment may generate the second compensation data based on the newly acquired information. For example, if the compensation data for compensating for the distortion of the display is not separately stored in the first memory 325 of the display, the processor 310 may acquire the second information in the same method as that as described above with reference to FIGS. 4 and 6, and generate the third information based on the acquired second information.

At operations 919 and 920, the processor 310 according to an embodiment may copy (store) the second compensation data in a cache region of the second memory 330, and then reboot (restart) the electronic device 300. According to an embodiment, if the electronic device 300 is rebooted, the processor 310 may start the system in a recovery mode.

According to another embodiment of the present disclosure, the processor 310 may omit operations 914, 915, and 916 in FIG. 9 based on the user's setting. For example, whenever the compensation of the image quality of the display is performed, the processor 310 according to another embodiment may update the compensation data stored in the first memory 325 of the display to set the updated compensation data as a default, read the original compensation data backuped from the second memory 330, and selectively perform the operations of compensating the image quality of the display (e.g., operations 914, 915, and 916 in FIG. 9) based on the original compensation data. For example, at operation 912, if the compensation data stored in the first memory 325 exists, the processor 310 according to another embodiment may read the first compensation data from the first memory 325. At operation 917, the processor 310 according to another embodiment may generate the second compensation data (e.g., third information as described above with reference to FIGS. 4 and 6) through combination of the first compensation data read from the first memory 325 with newly acquired information. At operation 919, the processor 310 according to another embodiment may respectively store the generated second compensation data in the first memory 325 and the second memory 330. For example, the processor 310 may update (replace) the existing first compensation data stored in the first memory 325 to (by) the second compensation data, store the second compensation data in the cache region of the second memory 330, and then reboot (restart) the whole system of the electronic device 300.

Figure 10:
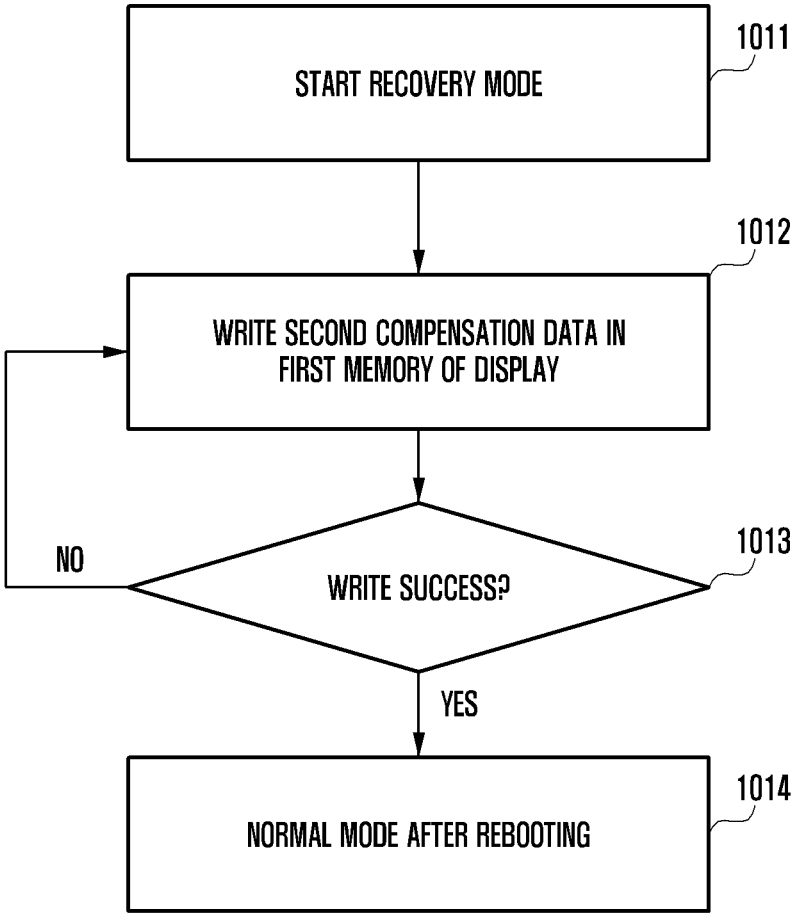
FIG. 10 is a flowchart illustrating a post-process in which an electronic device stores compensation data in a memory of a display.

FIG. 10 is a flowchart illustrating a post-process in which an electronic device stores compensation data in a memory of a display. For example, FIG. 10 may be a flowchart explaining in detail the post-process of operation 920 as illustrated in FIG. 9.

Referring to FIG. 10, the processor (e.g., processor 310 in FIG. 3) of the electronic device (e.g., electronic device 300 in FIG. 3) according to an embodiment, at operation 1011, may execute the recovery mode if the whole system of the electronic device 300 is rebooted.

At operation 1012, the processor 310 according to an embodiment may store the second compensation data copied to the cache region of the second memory (e.g., memory 330 in FIG. 1) in the first memory (e.g., memory 325 in FIG. 2) of the display (e.g., display 320 in FIG. 2).

At operations 1013 and 1014, if the storage of the second compensation data in the first memory 325 of the display 320 is completed, the processor 310 according to an embodiment may reboot the whole system of the electronic device 300, and drive the system of the electronic device 300 in a normal mode. According to an embodiment, if storage of the second compensation data in the first memory 325 of the display 320 has failed, the processor 310 may reattempt the storage operation as many as the designated number (e.g., three times). For example, if the storage has failed even if the storage operation is reattempted as many as the designated number (e.g., three times), the processor 310 returns to the user interface for compensating the image quality of the display 320 to display the error notification.

Figure 11:
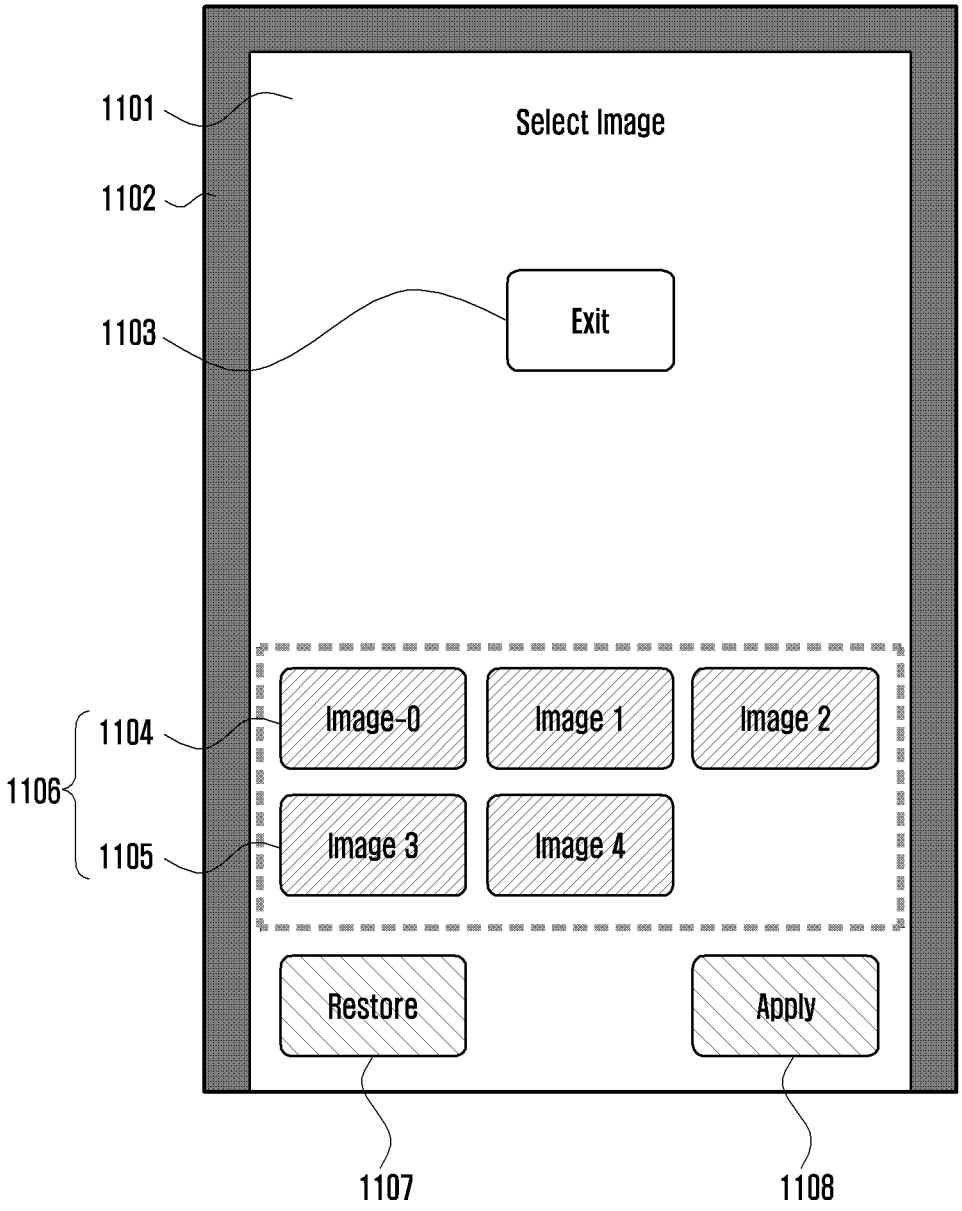
FIG. 11 is a diagram illustrating an example of a user interface for compensating an image quality of a display.
Figure 12:
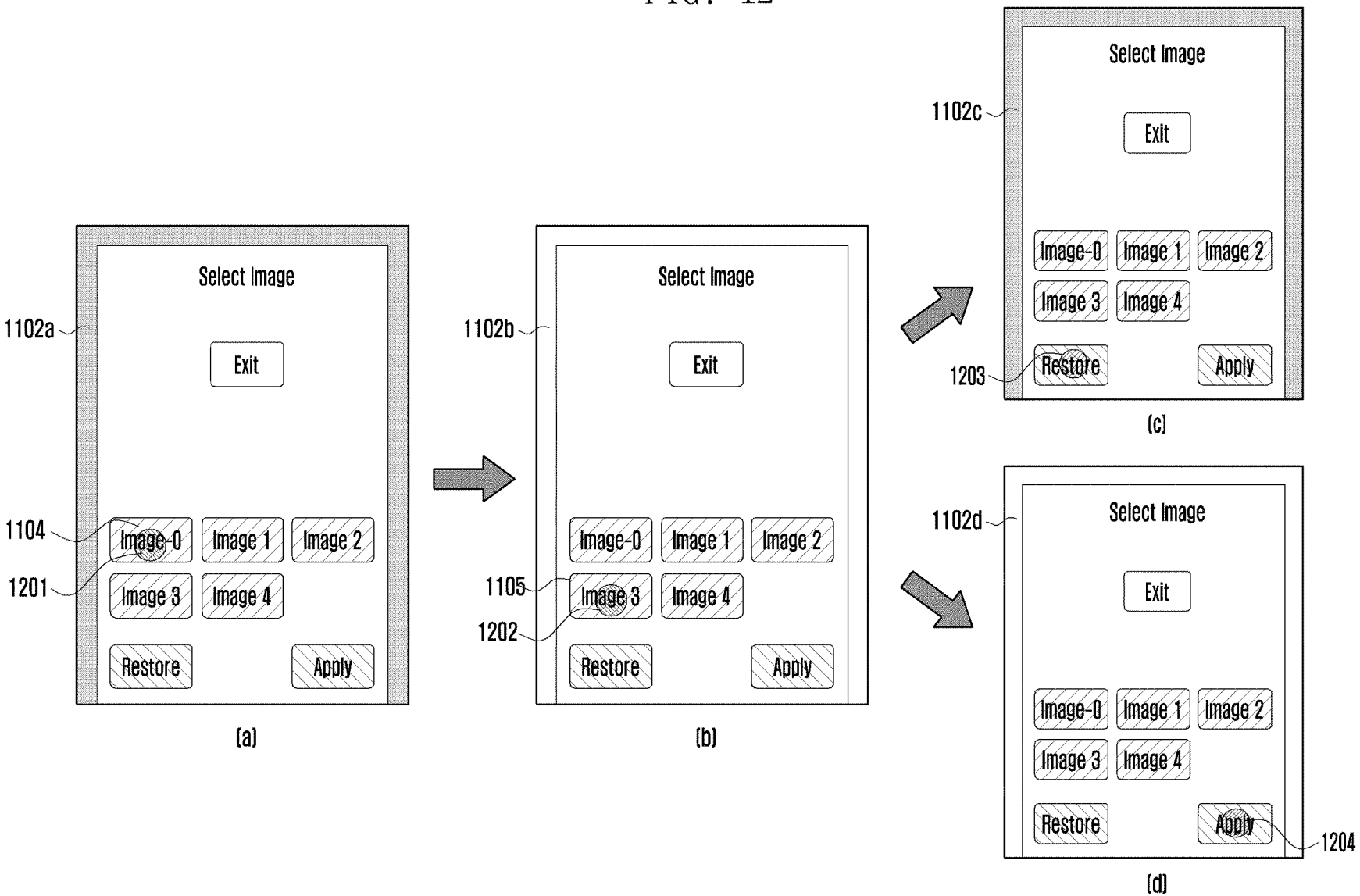
FIG. 12 is a diagram explaining a method for determining compensation data (second information) through a user interface.

FIG. 11 is a diagram illustrating an example of a user interface for compensating an image quality of a display, and FIG. 12 is a diagram explaining a method for determining compensation data (second information) through a user interface. For example, FIGS. 11 and 12 may be examples of a user interface for acquiring the second information as described above at operation 412 in FIG. 4.

Referring to FIG. 11, the processor (e.g., processor 310 in FIG. 3) may receive a user input for selecting a designated region 1102 through a user interface 1101. According to an embodiment, the designated region 1102 of the display (e.g., display 320 in FIG. 3) may include at least a partial region of the display 320. For example, the designated region 1102 of the display may include a border region 1102 of the display 320. Further, the designated region 1102 of the display 320 may include an edge region deployed on at least one side of the display 320. Further, the processor 310 may provide (display) a selection tool so that a user can directly set the designated region 1102 of the display 320. The processor 310 may determine the designated region 1102 in response to the user input using the selection tool. FIG. 11 exemplifies that the designated region 1102 is the border region 1102 of the display 320. For example, in FIG. 11, expression of the border region 1102 through hatching is to explain that the image quality distortion occurs in the border region 1102 and there exists a difference in color or grayscale between the border region 1102 and other regions.

According to an embodiment, the user interface 1101 may include a plurality of user selection menus or a plurality of icons 1106 mapped to different pieces of compensation information. For example, the processor 310 may display the user interface for compensating the image quality of the display 320, and acquire the second information based on the user's icon selection (or menu selection) through the user interface 1101. According to an embodiment, the user interface 1101 may include a plurality of icons (or menus) 1106 mapped to the application of the compensation data of the designated color with respect to the designated region 1102 of the display 320.

According to an embodiment, the user interface 1101 may further include an application icon 1108 for the user to apply the compensation data, a recovery icon 1107 for displaying the original frame image before the compensation data is applied, and an end icon 1103 for ending the user interface 1101.

Hereinafter, a process in which the processor 310 determines the second information based on the user input through the user interface 1101 will be described.

The processor 310 may display as a preview image an example in which the compensation data is applied to the data information applied to the plurality of pixels to display the current frame in response to the selection of any one 1104 of the plurality of icons 1106 by the user. For example, the processor 310 may display as the preview image an example in which the compensation data is applied to the data information applied to the pixels corresponding to the designated region 1102 in response to the selection of any one 1104 of the plurality of icons 1106 by the user. Referring to (a) of FIG. 12, the processor 310 may display a first preview image in response to the user's selection of the first icon 1104. For example, the first preview image may include an example in which the compensation data is applied with respect to the border region 1102 that is the designated region 1102. As denoted by 1102*a*, if the image quality distortion is identified by the user's naked eye in the border region 1102 in spite of the application of the compensation data with respect to the border region 1102, the user may select another icon to control the compensation data with another value.

If the user selects another icon 1105, the electronic device (e.g., electronic device 300 in FIG. 3) may display another preview image applied to the pixels of the region 1102 in which another compensation data is designated. For example, the electronic device 300 may change and display the preview image in response to a case where the user changes the selection of the plurality of icons 1106, and the user may determine the icon that can minimize the distortion of the display 320 through the changed preview image. Referring to (b) of FIG. 12, the processor 310 may display a second preview image in response to the user's selection of the second icon 1105. For example, the second preview image includes an example in which another compensation data is applied with respect to the border region 1102 that is the designated region 1102. As denoted as 1102*b*, if the second preview image corresponds to improvement of the image quality distortion with respect to the border region 1102, the user is unable to identify the image quality distortion in the border region 1102 by the naked eye.

Referring to (c) of FIG. 12, according to an embodiment, the processor 310 may display the original frame image before the compensation data is applied from the preview image in response to the user's selection of the recovery icon 1203. Accordingly, the original frame image displayed in response to the user's selection of the recovery icon may be an image in which the image quality distortion with respect to the border region 1102 is identified by the naked eye as denoted by 1102*c*.

Referring to (d) of FIG. 12, the user may select application of the selected icon after identifying the preview image in which the image quality distortion is improved. For example, as denoted by 1102*d*, the user may select the application icon 1204 after identifying that the image quality distortion with respect to the border region 1102 is not identified by the naked eye in the current preview image. According to an embodiment, the processor 310 may determine the compensation value for compensating the data information applied to the plurality of pixels, that is, the second information, in response to the selection of the application icon 1204 after the user identifies the preview image. For example, the second information may be compensation data corresponding to the icon finally selected and applied by the user.

Figure 13:
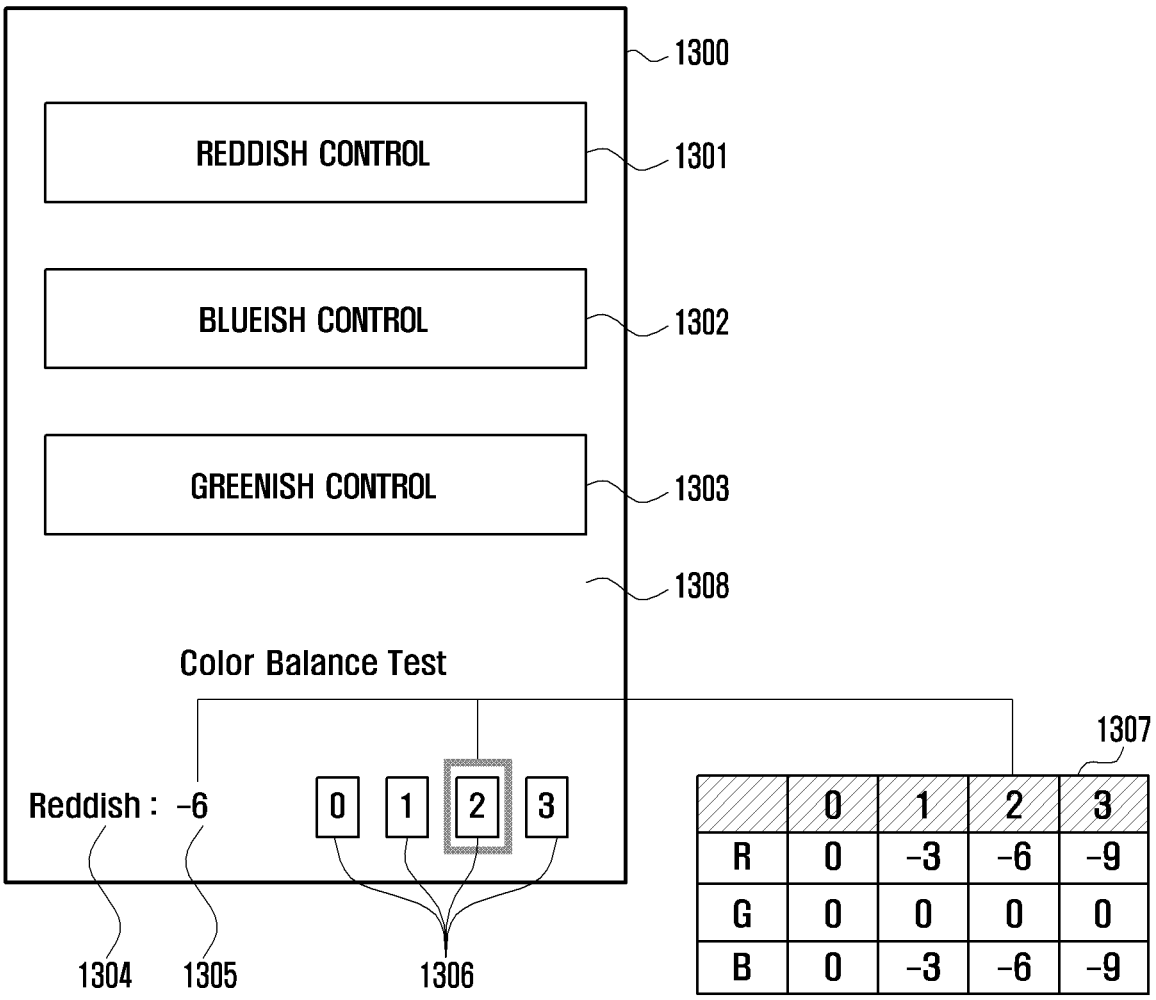
FIG. 13 is a diagram illustrating another example of a user interface for compensating an image quality of a display.

FIG. 13 is a diagram illustrating another example of a user interface for compensating an image quality of a display.

Referring to FIG. 13, a user interface 1300 may include a plurality of icons for compensating data of a designated color with respect to the designated region of the display (e.g., display 320 in FIG. 3). For example, the user interface 1300 may include a reddish control icon 1301 for controlling reddish with respect to the designated region, a blueish control icon 1302 for controlling blueish with respect to the designated region, and a greenish control icon 1303 for controlling greenish with respect to the designated region.

According to an embodiment, the processor (e.g., processor 310 in FIG. 3) may change the color of a background portion 1308 of the user interface in response to a user's icon selection. The user may determine the icon of which the image quality distortion is improved while identifying variation of the background portion 1308 of the user interface 1300. According to a certain embodiment, the processor 310 may divide the background portion into a first portion and a second portion in response to the user's icon selection, and the first portion may display the existing frame image, and the second portion may display an image in which at least one of the grayscale and the color of the frame image is varied corresponding to the selected icon. For example, the user may select the icon of which the image quality distortion is improved as identifying the difference between the first portion and the second portion by the naked eye, and the processor may acquire (or determine) the second information based on the user's selection.

According to an embodiment, the user interface 1300 may include a plurality of control icons 1306 for controlling the compensation value for the designated color in stages. For example, the plurality of control icons 1306 may be mapped in stages to the compensation data of the designated value with respect to the designated color. According to an embodiment, as denoted by a reference numeral 1307, a table 1307 to which compensation data values are mapped in stages corresponding to the plurality of control icons 1306 may be referred to. For example, as denoted by a reference numeral 1307, the compensation data values included in the table may be values for controlling the data information applied to the pixels in the designated region.

According to a certain embodiment, the user interface 1300 may further include a first information display region 1304 for displaying the currently controlled color and a second information display region 1305 for displaying the stage of the currently applied compensation data.

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

What is claimed is:

1. An electronic device comprising:

a display including a plurality of pixels, the plurality of pixels associated with corresponding pixel data, wherein the plurality of pixels generate colors based on the pixel data;

a first memory operably connected to the display configured to store first information for compensating the pixel data;

a second memory operably connected to at least one processor configured to store second information for compensating the pixel data; and the at least one processor, wherein the at least one processor is configured to generate third information for compensating the pixel data based on the first information and the second information and provide the third information to the display.

2. The electronic device of claim 1, wherein the at least one processor comprises an application processor and wherein the third information is stored in the first memory.

3. The electronic device of claim 1, wherein the at least one processor comprises a display driving circuit and wherein the third information is stored in the first memory.

4. The electronic device of claim 1, wherein the at least one processor comprises an application processor and wherein the third information is stored in the second memory.

5. The electronic device of claim 1, wherein the at least one processor comprises a display driving circuit and wherein the third information is stored in the second memory.

6. The electronic device of claim 1, wherein the at least one processor is configured to obtain the second information based on a user input.

7. The electronic device of claim 1, wherein the at least one processor is configured to obtain the second information from an external device.

8. The electronic device of claim 1, wherein the at least one processor is configured to:

convert at least one of grayscale information or color information of the pixel data to be applied to the plurality of pixels based on the third information, and display a frame image corresponding to the converted pixel data through the display.

* * * * *